United States Patent [19]

Ishizuka

[11] Patent Number: 4,481,085

[45] Date of Patent: Nov. 6, 1984

[54] APPARATUS AND METHOD FOR ELECTROLYSIS OF $MGCL_2$

[76] Inventor: Hiroshi Ishizuka, 19-2, Ebara 6-chome, Shinagawa-Ku, Tokyo, Japan

[21] Appl. No.: 475,740

[22] Filed: Mar. 16, 1983

[30] Foreign Application Priority Data

Mar. 16, 1982 [JP] Japan ..... 57-41571

[51] Int. Cl.[3] ..... C25C 3/04; C25C 7/00

[52] U.S. Cl. ..... 204/70; 204/244; 204/245; 204/268; 204/274; 204/246; 204/247

[58] Field of Search ..... 204/70, 243 R-247, 204/268, 274

[56] References Cited

U.S. PATENT DOCUMENTS

| | | | |
|---|---|---|---|
| 4,087,345 | 5/1978 | Sandvik et al. | 204/274 X |
| 4,089,769 | 5/1978 | Jennings | 204/274 X |
| 4,222,841 | 9/1980 | Miller | 204/274 X |
| 4,334,975 | 6/1982 | Ishizuka | 204/274 X |

*Primary Examiner*—Donald R. Valentine
*Attorney, Agent, or Firm*—Larson & Taylor

[57] ABSTRACT

An apparatus for electrolysis of $MgCl_2$, comprising an air-tightly sealed shell of metallic material, said shell exhibiting in horizontal cross section a rounded profile which comprises at four portions a curve selected from a quarter-circular arc and a quarter-elliptical arc, means for forcibly cooling said shell from outside, a wall structure which consists of an insulative refractory of a decreased thickness and which is provided along said shell, an electrolysis chamber defined by said wall structure and a pair of primary partitions extending in parallel with each other across the wall structure, a separation chamber provided in adjacency with the electrolysis chamber for stripping magnesium metal from electrolytic bath, at least one pair of anode and cathode arranged in the electrolysis chamber, at least one bipolar intermediate electrode arranged between the anode and cathode, and a top cover provided air-tightly over the electrolysis chamber and the separation chamber, thus allowing as a whole an electrolytic operation at a substantially regulated bath temperature with an increased number of electrodes.

20 Claims, 3 Drawing Figures

APPARATUS AND METHOD FOR ELECTROLYSIS OF $MGCL_2$

Figure 1:
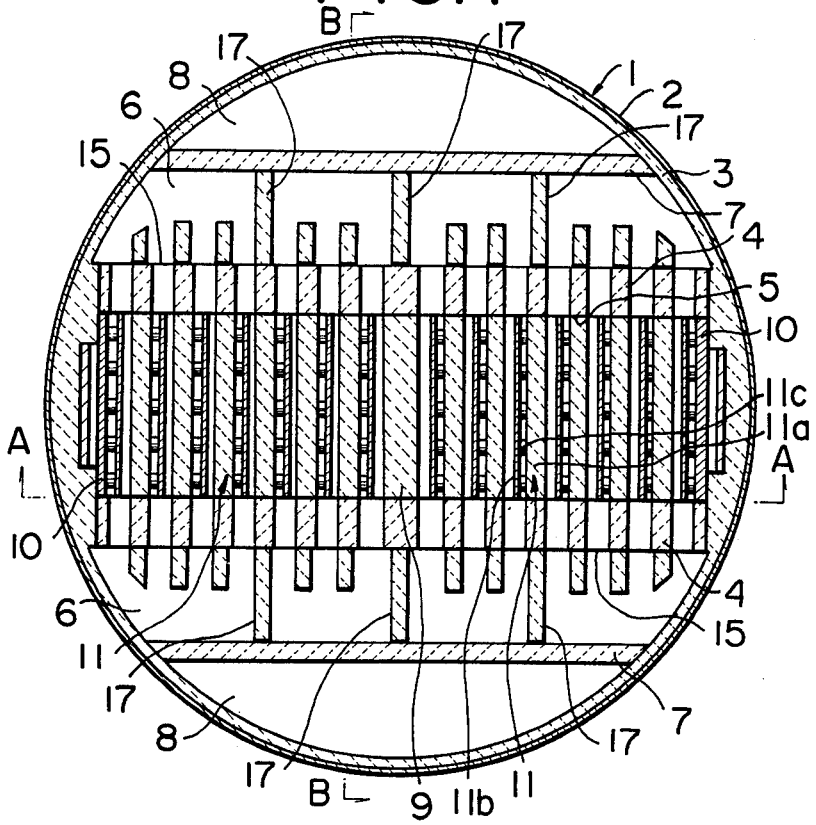

The present invention relates to an apparatus for electrolysis of fused salt which in particular comprises $MgCl_2$ and a method using such apparatus.

Electrolysis of $MgCl_2$ is commonly conducted by means of an arrangement which comprises a wall structure of insulative refractory and an outer shell of, usually, iron provided air-tightly over the wall structure, with a voltage applied sufficient to effect the electrolysis between adjacent pairs among a set or sets of electrodes which consist of anode, cathode and, in some cases, intermediate electrodes, all in series. As the refractory exhibits a substantially greater thermal expansion than the iron during electrolytic runs, some means should be necessarily taken for setting off resulting differential expansion of the refractory, for example, by providing adequate gaps among the bricks to consist the wall, by using another refractory which has a substantially higher compressibility as loaded between the wall and the shell.

It is desirable that electrolytic runs for $MgCl_2$ be conducted, for a substantially improved productivity, by using a cell construction of increased dimensions so that an increase may be achieved in number of electrodes contained in the cell, and therefore power input available for electrolysis.

Conventionally, such shell and wall structure have been proposed to be constructed in a substantially rectangular shape in horizontal cross section, as shown in U.S. Pat. No. 3,396,094 to Sivilotti et al, for facilitated construction or other reasons. This arrangement, however, only allows a limited improvement in productivity per unit floor area of cell, due to a limited increase available in either dimension of cell construction with an adequate strength or power input, as the differential expansion of the wall can only be set off incompletely because of a bath portion which penetrates and loads the gaps. Further, a wall thickness so increased as to exhibit a sufficient strength and to achieve an adequate temperature drop within will result in suppression of radiation of excess heat from the bath.

Therefore, one of the main objects of the present invention is to provide an electrolytic cell free of above said drawbacks, which comprises an outer shell of metallic material and of a partly or entirely circular or elliptical horizontal profile, said shell allowing forcible cooling on the surface, a wall structure provided inside the shell of a decreased thickness, relative to what would be required for adequate strength in a wall of rectangular shape an electrolysis chamber to effect electrolysis and a separation chamber for stripping magnesium metal product from the electrolytic bath to carry the metal, the latter chamber being attached to the former on one or two sides thereof. According to the invention there is provided an apparatus for electrolysis of $MgCl_2$, comprising an air-tightly sealed shell of metallic material, said shell exhibiting in horizontal cross section a rounded profile which comprises at four portions a curve selected from a quarter-circular arc and a quarter-elliptical arc, means for forcibly cooling said shell from outside, a wall structure which comprises an insulative refractory and which is provided along said shell, an electrolysis chamber defined by said wall structure and a pair of primary partitions extending in parallel with each other across the wall structure, a separation chamber provided in adjacency with the electrolysis chamber for stripping magnesium metal from electrolytic bath at least one pair of anode and cathode arranged in the electrolysis chamber at least one bipolar intermediate electrode arranged between the anode and cathode, and a top cover provided air-tightly over the electrolysis chamber and the separation chamber. The refractory wall structure may be of decreased thickness relative to what would be required for sufficient strength in a rectangular call. Thus, the apparatus as a whole allows an electrolytic operation at a substantially regulated bath temperature with an increased number of electrodes contained in the cell.

Such apparatus can take various designs. For example, the shell can be cooled by blowing air of a lowered temperature onto the shell, by passing water in a closed jacket provided on the shell to cover a substantial part thereof, or with water sprayed and flowing down on the outer surface. The rounded horizontal profile of the wall structure and the shell may consist of a complete circle or ellipsis, or alternatively of such hybrid shapes as to comprise either one or two pairs of straight lines in parallel with each other. In the case of hybrid profiles, the circular or elliptical curved portions should exhibit a radius or half-minor-axis, respectively, which does not exceed the half length of the minor side of circumscribed rectangle or, in the case of square, the half length of the side. The electrolysis chamber may consist of a single room or of two compartments running lengthwise in parallel with each other. Although the reverse is possible in case of a secured insulation available, it is preferred that an anode, at a higher voltage, be positioned inwards in the electrolysis chamber while placing a cathode, at a lower voltage, at an outer end, so that an increased insulative distance may be kept from the metallic shell, thus minimizing possible current leakage through the electrolytic bath. This anode arrangement allows elimination of the power loss which would be inevitable to some degree in case of end anode arrangement, said loss being caused by electrolytic bath penetrating into the gap between the anode and the shell. The present of the bath there is harmful in two ways: electrical passage will be made up by the electrolyte itself and moreover by any magnesium metal deposited by electrolysis, proceeding there. Thus the anode of the invention is arranged most advantageously at a center of the single or double compartmented electrolysis chamber. Such arrangement also is available that another cathode is arranged at a center of the chamber, thus referred to as center cathode, while an anode is placed between the cathodes at the center and at the end. In case of provision of center cathode, two separate plates of iron, arranged on the back with an insulative partition therebetween, are used to serve for the set of electrodes on each side, while when an anode is positioned at the center, a single graphite slab conveniently may be used for either side. In each case, one or more bipolar electrodes are advantageously arranged between each pair of anode and cathode as intermediate electrodes. All the electrodes are seated on their respective stands of insulative material for keeping effective faces of electrodes well above the sludge which deposits and accumulates on the floor and which is often electrically conductive because of magnesium particles trapped within. The stands are of a solid design to block transverse passage of leakage current, although they conveniently can have a limited opening to let through. Pieces of insulative material such as used in Japanese KOKAI Publication No. 47887/80, are preferably employed in the invention for minimizing current leakage. The anode and cathode of the invention are so arranged that terminals for electrical connection may be provided through a top cover over the electrolysis chamber, thus securing a shell construction improved in rigidity and bath sealing.

The primary partitions have a row of through holes between adjacent pairs of electrode for the bath to flow towards the separation chamber and unload magnesium metal, from a level above the intermediate electrodes, and back towards the electrolysis chamber below the intermediate electrodes. For an improved suppression against current leakage, the primary partitions between the two chambers are formed to exhibit an increased thickness, generally or partly in adjacency with the holes at the bath level alternatively the partition may have a projection of insulative material running in the separation chamber, thus providing a substantially extended path for leaking current between the electrodes through the bath in the hole and separation chamber. Such projection conveniently can consist of a row of fin-like members with an adequate width. The members should not be necessarily wide enough to reach the wall structure although it is preferable that a member of an increased length be added among regularly shorter ones. In any event width is necessary to cover a level range which includes the bath surface level to be used.

The separation chamber consists of a single chamber or two sections divided by a secondary partition of an insulative refractory arranged in parallel with the primary ones, such that electrolyte bath carrying magnesium metal can overflow from the inner to the outer section where the metal is accumulated and recovered. The outer section referred to as magnesium reservoir conveniently consists of a single chamber. In case of a single chamber design of electrolysis chamber, the chamber on one side of the chamber may be used for metal/bath separation while the other as $MgCl_2$ reservoir where the chloride is introduced for temporary storage and is supplied therefrom through openings in the partition at the bottom into the electrolysis chamber either continuously or intermittently for an electrolysis run at a substantially regular bath level so that stabilized operational conditions can be maintained.

In one embodiment, an additional small chamber is provided within one of the separation chambers, said small chamber comprising an air-tightly closed top and an open bottom with means for pressure control and for introduction of $MgCl_2$ from an outside source, such that $MgCl_2$ may be introduced there and be pushed out through the bottom by increasing the pressure in a cavity over the liquid chloride.

As the apparatus of the invention characteristically can exhibit substantially increased physical properties, an increased number of electrodes may be provided for improved productivity. Further the wall structure of a decreased thickness combined with the forcible cooling means for the shell allows an effective cooling for electrolytic bath inside it; in a specific case the bath is cooled to such degree that a kind of lining of a lowered electrical conductivity may be formed on the wall structure.

Other objects and various features of the present invention will be better understood from the following description taken in connection with the accompanying drawing which is given by way of example only.

Figure 2:
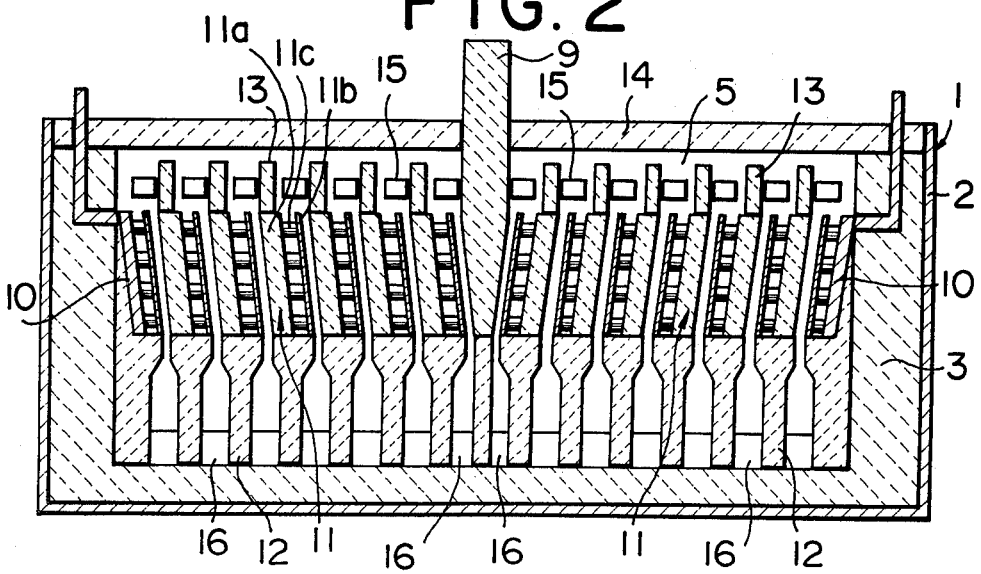
Figure 3:
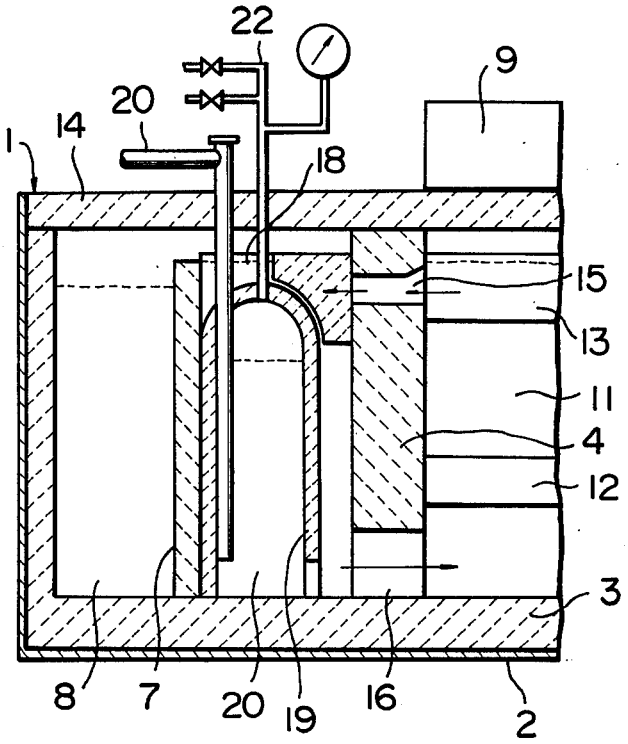

FIG. 1 schematically shows a horizontal view in section of an apparatus for electrolysis of $MgCl_2$ constructed according to the invention, FIG. 2 shows an elevational view in section of such apparatus, as taken along A-A on FIG. 1, and FIG. 3 shows a special example in part where an additional small chamber is provided within the separation chamber for bath level control, the sectional view as taken along B-B on FIG. 1.

In the figures the apparatus, generally designated at 1, comprises an outer shell 2 formed cylindrically of an SS grade carbon steel, according to JIS, and a wall structure 3 of bricks of such electrically insulative refractory as alumina. The space inside the wall structure is divided by primary partitions 4 into an electrolysis chamber 5 and metal/bath separation chamber 6 on either side, the latter being divided by secondary, partitions 7 of a height somewhat lower than the bath level to be used into two sections, the outer one 8 of which serves as magnesium reservoir. The partitions 4, 7 consist of an insulative material which conveniently is alumina as formed in bricks. Electrodes are so arranged in the electrolysis chamber 5 that an anode 9 of graphite is positioned at a center of the chamber 5, while a cathode 10 of iron at each end, and in a row between the anode 9 and cathodes 10 several intermediate electrodes which consist of a graphite slab 11*a* and an iron plate 11*b* joined together with iron rods 11*c*, said intermediate electrodes being generally designated at 11. The anode 9, cathode 10 and intermediate electrodes 11 are all seated on respective stands 12, which consist of insulative bricks and have a cross section to block the whole area below the electrodes. An elongated block 13, exhibiting such height and width that an area up to a level slightly above the bath surface level may be covered, is laid on each of intermediate electrodes 11 for minimizing current leakage to be caused between adjacent electrodes through the bath and/or magnesium metal afloat. An end of either the iron or graphite consisting the cathode or anode, respectively, extend through a top cover 14 over the chamber 5 to serve as terminal for electrical wiring. The partitions between the chambers 5, 6 have through holes 15, 16 for electrolytic bath to pass therethrough in alignment with each gap between the electrodes or stands 12, so that the bath may come into the separation chamber 6 for unloading the metallic product and back into the electrolysis chamber 5 for the process, respectively. Although not essential to the invention but advantagesous in particularly minimizing the power loss to be caused by stray current through the bath, the separation chamber 6 in the illustrated example has such insulative members as attached thereto as a partition 17 which rises up from the floor to a level somewhat above the bath surface oppositely between each pair of anode 9 and cathode 10, and a smaller member 18 as hanging over between adjacent through holes 15 (FIG. 1). A closed small space in provided in some instances of the invention in the separation chamber for achieving a stabilized electric run by maintaining the bath surface at a substantially regular level. An example of such design in shown in FIG. 3. A hollow cylindrical body 19 of an inversed bell form, arranged with the top below the bath level, defines a small chamber 20 where $MgCl_2$ is introduced from an outside source (not shown) through a pipe 20 and where pressure is controllable with an argon gas put in or out through another pipe 22. As the ingredient is consumed with proceeding electrolysis, magnesium chloride is pushed out through the bottom into the separation chamber and finally to the electrolysis chamber for maintaining a regular bath level. When the bath level in the chamber 20 is close to the bottom, $MgCl_2$ is introduced anew through the pipe 21 by decreasing the pressure in the chamber 20.

The secondary partitions 7 in the separation chamber 6 have a top slightly below the bath level at the electrolysis chamber so that bath carrying magnesium metal may overflow from the inner to the outer section, where the metallic product is unloaded, accumulated and taken out continuously or at intervals for pouring into ingots or for transferring as fused to Kroll process plants.

The shell 2 of the invention has a device (not shown) to blow air of a lowered temperature onto the outer surface, so that electrolytic bath inside may be cooled to a level within a desired temperature range, by efficiently removing heat generated during the electrolytic process.

In a preferred example, cooling is made to such degree that bath may be partly solidified to deposit a kind of lining of a lowered electrical conductivity on the wall structure 3, thus further minimizing any current leakage between the shell and the electrodes at raised voltages through the bath.

EXAMPLE

An apparatus was used which is basically illustrated in FIGS. 1 and 2. A cylindrical shell of an SS grade carbon steel was 6 m across and 2.5 m high and is coolable on the outer surface with water flowing down on the surface. A some 20 cm thick wall of alumina bricks comprised an electrolysis chamber whose inside dimensions were 1.25 m × 5 m × 2.2 m. A graphite slab 1.25 m × 2.5 m wide was used as anode, and an iron plate 1.25 m × 0.8 m wide as cathode at each end of the chamber, while nine intermediate electrodes arranged between the anode and each cathode consisted of a graphite slab and an iron plate joined together with several threaded bolts of iron, as planted in the graphite and welded to the iron. A voltage of 38 V was applied between each cathode and anode to effect electrolysis of $MgCl_2$. Such process was continued at 6000 A (or, at a current density of 0.6 $A/cm^2$) for 24 hours, with yields at the end of 1.2 tons of magnesium metal and 3.5 tons of chlorine gas.

As described above in detail, the present invention advantageously employs a metallic shell and a wall structure, each, of a rounded design, said wall structure exhibitng a thus available decreased thickness relative to the thickness required for adequate strength in a wall of rectangular shape. A means has also been introduced to the shell for forcible cooling.

Thus comprising, the invention has achieved:

1. Due to an improved heat removal, an increased power input is available for a raised productivity of the metal and gas;

2. Differential expansion between the refractory, to consist the wall, and the metal, to consist the shell, is efficiently set off, so that the whole structure can exhibit an improved physical strength, thus an apparatus can be realized in substantially enlarged dimensions. That means improvement in number of electrodes to be contained in the apparatus, or productivity in other words, per unit area of plant floor;

3. In cases where a substantially extended distance is provided for secured insulation between the anode and the metallic shell by arranging the former at a center of the electrolysis chamber and/or where a lining of a lowered electrical conductivity is formed on the wall structure to secure further improved insulance, stray current therebetween is cut for a substantial part, so that electrolysis is achievable at much raised anode voltage, with an increased number of intermediate electrodes arranged in series between the anode and cathode.

What I claim is:

1. Apparatus for electrolysis of $MgCl_2$, comprising an air-tightly sealed shell of metallic material, said shell exhibiting in horizontal cross section a rounded profile which comprises at four portions a curve selected from a quarter-circular arc and a quarter-elliptical arc, means for forcibly cooling said shell from outside, a wall structure which comprises an insulative refractory which is provided along said shell, an electrolysis chamber defined by said wall structure and a pair of primary partitions extending in parallel with each other across the wall structure, a separation chamber located in adjacency with the electrolysis chamber for stripping magnesium metal from an electrolytic bath, at least one pair of anode and cathode arranged in the electrolysis chamber, at least one bipolar intermediate electrode arranged between the anode and cathode, and a top cover provided air-tightly over the electrolysis chamber and the separation chamber.

2. The apparatus as recited in claim 1, in which said cooling means substantially comprises means for blowing air onto the shell.

3. The apparatus as recited in claim 1, in which said cooling means substantially comprises a closed jacket and means for passing coolant water through said jacket.

4. The apparatus as recited in claim 1, in which said cooling means substantially comprises means for spraying coolant water on the shell.

5. The apparatus as recited in claim 1, in which said profile comprises a pair of parallel lines between the arcs.

6. The apparatus as recited in claim 1, in which said profile comprises two pairs of parallel lines.

7. The apparatus as recited in claim 1, in which said curves are joined with each other to substantially make a circle.

8. The apparatus as recited in claim 1, in which said curves are joined with each other to substantially make an ellipsis.

9. The apparatus as recited in claim 1, in which said electrolysis chamber comprises two compartments, separated from each other with an insulative refractory partition arranged in parallel with the primary partitions.

10. The apparatus as recited in claim 9, in which said compartments each have a cathode at each end thereof, another cathode at the center thereof, and an anode between said cathodes.

11. The apparatus as recited in claim 1, in which said electrolysis chamber has an anode disposed vertically across the chamber at a center thereof.

12. The apparatus as recited in claim 1, in which said electrolysis chamber has an anode across at each end thereof.

13. The apparatus as recited in claim 1, in which said electrolysis chamber has a cathode at each end thereof.

14. The apparatus as recited in claim 13, in which said electrolysis chamber has another cathode placed at a center thereof and an anode between said cathode and a cathode at each end thereof.

15. The apparatus as recited in claim 1, in which said anode, cathode and intermediate electrodes are separated from the bottom of the electrolysis chamber by a row of insulative refractory arranged in a row with a space therebetween.

16. The apparatus as recited in claim 1, in which said separation chamber substantially comprises two sections separated from each other by a secondary partition extending parallel to the primary partitions.

17. Apparatus for electrolysis of $MgCl_2$, comprising an air-tightly sealed shell of metallic material, said shell exhibiting in horizontal cross section a rounded profile which comprises at four portions a curve selected from a quarter-circular arc and a quarter-elliptical arc, means for forcibly cooling said shell from outside, a wall structure which comprises an insulative refractory and which is provided along said shell, an electrolysis chamber defined by said wall structure and a pair of primary partitions extending in parallel with each other across the wall structure, a separation chamber, for stripping magnesium metal from electrolytic bath, provided in adjacency with the electrolysis chamber, at least one pair of anode and cathode arranged in the electrolysis chamber, at least one bipolar intermediate electrode arranged between the anode and cathode, a holding chamber for $MgCl_2$ provided within the separation chamber, said chamber having a closed top and open bottom as well as means for introducing $MgCl_2$ thereto and for pressure control such that $MgCl_2$ may be pushed out from the chamber through the bottom as pressure in a cavity thereover is raised, so that electrolysis is possible substantially at a regular bath level, and a top cover provided air-tightly over the electrolysis chamber and the separation chamber.

18. The apparatus as recited in claim 17, in which said primary partition has at least one fin-like member which extends in the separation chamber so that a vertical range which includes the surface level is covered.

19. A method for electrolysis of $MgCl_2$, comprising providing a shell of metallic material which has in horizontal cross section a rounded profile which comprises at four portions a curve selected from a quarter-circular arc and a quarter-elliptical arc, and a wall structure of insulative refractory said wall structure being arranged along said shell, holding a fused electrolytic bath which comprises $MgCl_2$ in a space defined by the wall structure, applying such voltage that electrolysis of $MgCl_2$ may be caused through an anode and cathode, and conducting electrolysis while said bath is forcibly cooled from outside through the metallic shell to a lowered temperature level with a coolant selected from air blown onto the shell and water moving along the shell.

20. The method as recited in claim 19, in which said temperature level is such that electrolytic bath may be partly solidified and form a lining of a lowered electrical conductivity.

* * * * *